US008486882B2

(12) United States Patent
Bayless et al.

(10) Patent No.: US 8,486,882 B2
(45) Date of Patent: Jul. 16, 2013

(54) METAL CLEANER POLISHER AND ANTI-TARNISH SOLUTION

(76) Inventors: Randy B. Bayless, Temecula, CA (US); Garen R. Bayless, Temecula, CA (US)

( * ) Notice: Subject to any disclaimer, the term of this patent is extended or adjusted under 35 U.S.C. 154(b) by 103 days.

(21) Appl. No.: 13/267,238

(22) Filed: Oct. 6, 2011

(65) Prior Publication Data

US 2012/0088711 A1 Apr. 12, 2012

Related U.S. Application Data

(60) Provisional application No. 61/391,275, filed on Oct. 8, 2010.

(51) Int. Cl.

| | |
|---|---|
| ***C11D 1/88*** | (2006.01) |
| ***C11D 3/20*** | (2006.01) |
| ***C11D 3/26*** | (2006.01) |
| ***C11D 3/34*** | (2006.01) |
| ***C11D 3/43*** | (2006.01) |

(52) U.S. Cl.

USPC ..... 510/245; 510/253; 510/254; 510/255; 510/256; 510/263; 510/264; 510/268; 510/492; 510/499; 510/501; 510/505; 510/506

(58) Field of Classification Search

USPC ..... 510/245, 253, 254, 255, 256, 263, 510/264, 268, 492, 499, 501, 505, 506

See application file for complete search history.

(56) References Cited

U.S. PATENT DOCUMENTS

| | | | | |
|---|---|---|---|---|
| 4,970,014 | A * | 11/1990 | Garcia | 252/79.3 |
| 6,172,025 | B1 * | 1/2001 | Johnson et al. | 510/241 |
| 6,425,929 | B1 * | 7/2002 | Naney | 51/308 |
| 6,780,212 | B1 * | 8/2004 | Luctman | 51/307 |
| 6,896,739 | B1 * | 5/2005 | Croce | 134/2 |
| 7,045,492 | B2 * | 5/2006 | Jenevein et al. | 510/189 |
| 2009/0170744 | A1 * | 7/2009 | Meine et al. | 510/302 |

* cited by examiner

*Primary Examiner* — Gregory Delcotto

(74) *Attorney, Agent, or Firm* — Richard D. Charles

(57) ABSTRACT

The present invention is directed to a metal cleaner polisher and anti-tarnish solution which comprises the following ingredients per 32 fluid ounces: 5.00 to 10.00 percent mineral spirits by volume; 1.50 to 4.50 percent ethanol by volume; 0.50 to 1.50 percent ammonia by volume; 0.50 to 1.50 percent thiourea by volume; 0.25 to 1.00 percent sulfamic acid by volume; less than 0.20 percent disodium cocoampho-diproprionate by volume; and deionized water. Optionally, the following ingredients may be added individually, in any combination or all together: thickening/suspension agents; abrasive additives; and a modifying/stabilizing agent; and optionally varying amounts of fragrance and colorizing agents.

20 Claims, No Drawings

METAL CLEANER POLISHER AND ANTI-TARNISH SOLUTION

This application claims priority under 35 USC 119(e) to provisional application 61/391,275, filed Oct. 8, 2010.

FIELD OF THE INVENTION

The present invention is directed to a metal cleaner, metal polish, and anti-tarnish solution and method for making same. More particularly the present invention provides a solution effective, efficient and economical in cleaning, polishing and protecting metal articles of manufacture and metal finishes.

BACKGROUND OF THE INVENTION

There have been many attempts to formulate an effective solution for cleaning and polishing metal surfaces of all kinds. There have been a number of soft metal cleaners and polishes available for brass etc. Recently, many articles of manufacture are made from aluminum. Many of these articles require a bright finish before the article can be placed in commerce to be sold. For example, in the manufacture of aluminum and other metal trailers, and liquid hauling tanker trucks, the desired finish is brilliant bright, and in some cases a mirror-like finish is required. The existing products and compounds on the market today require a great amount of cleaning, polishing and buffing work to gain the desired finish. Additionally, many of today's products contain chemicals that are not healthy, or eco-friendly. In some cases, these chemicals require health warnings, and some require special disposal regulations.

For example, U.S. Pat. No. 4,970,014 issued to Garcia provides for an acidic solution for use as an aluminum cleaning and brightening composition includes an aqueous solution of from about 1-15 weight percent hydrofluoric acid, about 1-5 weight percent sulfuric acid, and about 1-5 weight percent phosphoric acid. In addition, approximately 83-97 weight percent of an aqueous hydrochloric acid-based composition is included, which composition has a pH of less than about 1.0 yet is substantially non-reactive with compounds having low oxidative states, including human skin tissue.

U.S. Pat. No. 6,172,025 issued to Johnson et al. provides for a vehicle cleaning solution including a predetermined amount of mineral spirits and a predetermined amount of jeweler's rouge mixed with the mineral spirits for cleaning various vehicular components.

U.S. Pat. No. 6,425,929 issued to Naney provides a metal cleaner-polish in the form of a substantially homogeneous liquid slurry containing aliphatic hydrocarbons, finely divided abrasive, and isopropanol as a stabilizer/solvent.

U.S. Pat. No. 6,780,212 issued to Luctman provides a finishing composition for a variety of surfaces, including, without limitation, paints, metals, plastics and fiberglass, comprises water, wax, soap, scent, hair conditioner, mineral spirits and abrasives.

U.S. Pat. No. 6,896,739 issued to Croce provides an aqueous solution that has the capacity for removing tarnish and other soil from copper, silver, gold and other noble metals and alloys thereof comprises an acid, thioruease and a transition metal salt. The aqueous material can be used to treat the surfaces of such articles for the purpose of removing tarnish. Such tarnish is removed by the composition and the composition treats the metal surface to retard the re-appearance of tarnish contaminants.

U.S. Pat. No. 7,045,492 issued to Jenevein et al. provides a cleaning composition for treating and removing residues containing hydrocarbons and other flammable substances uses a mixture of one or move cleaning members containing quaternary salts, a chelator and a dispersant, mixed with water. The preferred cleaning members are tetradecyltrim-thylammonium bromide, tetrasodium ethylenediaminetetraacetic acid, benzethonium hydrochloride and 2-butoxyethanol. The chelator is tetrasodium, salt ethylenediamine of tetraacetic acid, and the dispersant is polyvinyl alcohol. Optionally, the cleaner contains ethanol and isopropyl alcohol.

In nearly all of the above cases, the patented solution contains chemicals or compounds that are environmentally unfriendly, or can cause human skin or tissue irritation or injury. In some instances the chemicals present in these formulations are known to cause cancer. Moreover, the compounds and solutions do not clean and polish metal with very much efficiency or effectiveness, that is, a great amount of work cleaning and polishing are required to gain the desired finish. Most do not remain in suspension or possess a pleasant odor. Finally, these solutions do not confer long lasting anti-tarnish effects. Therefore, it would be highly desirable to have a metal cleaner polisher and anti-tarnish solution that was effective, efficient, and economical to use, as well as eco-friendly and gentle to human skin and tissue.

In this respect, before explaining at least one embodiment of the invention in detail it is to be understood that the invention is not limited in its application to the details of composition and to the formulation of the ingredients set forth in the following description. The invention is capable of other embodiments and of being practiced and carried out in various ways. In addition, it is to be understood that the phraseology and terminology employed herein are for the purpose of description and should not be regarded as limiting.

SUMMARY OF THE INVENTION

The principle advantage of this invention is to provide a metal cleaner, metal polish, and anti-tarnish solution which is highly effective and requires less work time and effort to produce the desired finish on all metal types.

Another advantage of this invention is to provide a metal cleaner, metal polish, and anti-tarnish solution which is highly efficient and requires less amount of product to attain the desired finish on all metal types.

Another advantage of this invention is to provide a metal cleaner, metal polish, and anti-tarnish solution which is highly economical and requires less dollar amount of product to attain the desired finish on all metal types.

Another object of this invention is to provide a metal cleaner, metal polish, and anti-tarnish solution which is eco-friendly.

Another object of this invention is to provide a metal cleaner, metal polish, and anti-tarnish solution which is gentle on human skin and tissue.

Another object of this invention is to provide a metal cleaner, metal polish, and anti-tarnish solution which stays in suspension when optional ingredients are employed.

And yet another object of this invention is to provide a metal cleaner, metal polish, and anti-tarnish solution which may contain any of several different abrasive compounds depending upon the metal to be polished and the desired finish.

A further object of this invention is to provide a metal cleaner, metal polish, and anti-tarnish solution which may contain any of several different fragrance additive compounds.

And yet a further object of this invention is to provide a metal cleaner, metal polish, and anti-tarnish solution which may contain any of several different colorizing additive compounds.

Therefore, in accordance with the present invention, the preferred embodiment of the metal cleaner, metal polish, and anti-tarnish solution comprises the following ingredients per 32 fluid ounces: 5.00 to 10.00 percent mineral spirits by volume; 1.50 to 4.50 percent ethanol by volume; 0.50 to 1.50 percent ammonia by volume; 0.50 to 1.50 percent thiourea by volume; 0.25 to 1.00 percent sulfamic acid by volume; less than 0.20 percent disodium cocoampho-diproprionate by volume; and fill up (q.s.) to 32 ozs. with deionized water (see Table 1 below in detailed description). Optionally, the following may be added individually or all together: 1 to 3 dry grams of xanthan gum, or equivalent, as a suspension agent; 2 to 10 grams of abrasive additive (Jewelers rouge, Alumuna, etc., see Table 2 below in detailed description); and varying amounts of fragrance and colorizing agents as desired, again all per 32 ozs. liquid volume metal cleaner polisher solution.

In other embodiments of the metal cleaner, metal polish, and anti-tarnish solution invention equivalents of the chemicals outlines above could be used. For example, other solvents may be substituted for mineral spirits, such as mineral oil. Other alcohols could be substituted for ethanol, such as methanol, isopropyl alcohol, etc. Ammonia may be substituted for with an equivalent chemical, or left out all together, depending upon the metal cleaning polishing application. Sulfamic acid may be substituted by other acids such as citric acid, phosphoric acid, etc. Thiourea may be substituted by equivalent chemicals containing urea. Disodium cocoampho-diproprionate can be substituted or completely eliminated as it is in such a small percentage in the preferred embodiment. Finally, deionized water can be substituted by distilled water, reverse osmosis or other method achieving purified water, or tap water.

It must be clearly understood at this time although the preferred embodiment of the invention consists of a metal cleaner, metal polish, and anti-tarnish solution containing mineral spirits, ethanol, ammonia, thiourea, sulfamic acid, disodium cocoampho-diproprionate and water, that many other equivalent conventional chemicals exist, including alcohol substitutes for ethanol, ammonia substitutes, varying suspension agents and varying abrasive additives, or combinations thereof, that will achieve the a similar composition and effect, and they will also be fully covered within the scope of this patent.

With respect to the above description then, it is to be realized that the optimum ingredient proportional relationships for the ingredients of the invention, to include variations in materials, function and manner of use, are deemed readily apparent and obvious to one skilled in the art, and all equivalent relationships to those described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact composition and method disclosed and described, and accordingly, all suitable modifications and equivalents may be resorted to, falling within the scope of the invention.

DETAILED DESCRIPTION OF THE PREFERRED EMBODIMENTS

For a fuller understanding of the nature and objects of the invention, reference should be had to the following detailed description taken in conjunction with the accompanying ingredients tables, wherein the similar and option ingredients of the invention are identified.

In the preferred embodiment of the present metal cleaner polisher and anti-tarnishing solution, the required ingredient chemicals are listed in Table 1 below.

TABLE 1

| LIST OF REQUIRED INGREDIENTS | |
|---|---|
| 1. Mineral Spirits | 7.00-10.00% by volume |
| 2. Ethanol | 1.5-1.50% by volume |
| 3. Ammonia | 0.5-1.50% by volume |
| 4. Thiourea | 0.5-1.50% by volume |
| 5. Sulfamic Acid | 0.25-1.00% by volume |
| 6. Disodium Cocoampho - diproprionate | <0.20% by volume |
| 7. Deionized Water | q.s. to 32 oz. |

Optionally, the ingredients labeled optional, seen here in Table 2 below, may also be added, all, or singularly, or in any combination, per formulation of the metal cleaner polisher and anti-tarnish solution, to customize the solution for commercial marketing and for differing applications and uses.

TABLE 2

| LIST OF OPTIONAL INGREDIENTS | |
|---|---|
| 1. Thickener/suspension agent (optional) | 1-3 grams/32 oz. |
| 2. Abrasives (optional) | 2-10 grams/32 oz. |
| 3. Fragrance (optional) | essence of <1% |
| 4. Colorizing Agent (optional) | as needed <1% |
| 5. Modifier/stabilizer agent (optional) | 1-4 ozs. liquid/32 oz. |

Additionally, many abrasive compounds are known to produce many different finishes on differing metals. Table 3, below, outlines some of the possible abrasives that may be optionally added to the present metal cleaning polishing and anti-tarnish solution, and that particular abrasive additives use and finish characteristics are given. All of the listed abrasives may be in the form of many varying grit sizes, again, depending upon the application and or metal to be cleaned or polished.

TABLE 3

LIST OF EXAMPLE ABRASIVE ADDITIVES

| Abrasive | Used on | Finish |
|---|---|---|
| Iron III Oxide (general) | All metals | bright shine |
| Fine Red Oxide (Jeweler's Rouge) | Soft metals only (e.g. Brass, etc.) | brilliant bright mirror shine |
| Fine Green Oxide (Chrome Rouge) | All metals | brilliant bright mirror shine |
| Aluminum Oxide (Alumina) | All metals | brilliant bright mirror shine |
| Tripoli Powder | All metals | buffed shine (autos and boats) |
| Whiting Powder | All metals | clean dry shine (and free of all grease and dirt) |

Furthermore, while the ethanol or isopropyl alcohol acts as a stabilizer and homogenizer, when abrasives are added, they have a tendency to fall out of solution, ending up at the bottom of the container. In these cases, the container must be shaken before use. In the present inventive solution, xanthan gum is optionally employed as a suspension agent, effectively keeping all of the ingredients in a homogenized suspension. In this way, the preferred metal cleaner polisher, with xanthan gum included, does not require shaking before use.

Additionally, commercially available detergent grade rheology modifiers and stabilizers could be employed as suspension, thickening, and stabilizing enhancers. For example, Acusol 880 and Acusol 882 represent hydrophobically modified non-ionic polyol (HEURs) thickeners and stabilizers commonly used in detergent formulations for household and industrial applications. The addition of Acusol 880 will thicken and stabilize the present metal cleaner polisher, and with Acusol 880 included the solution will not require shaking before use. Furthermore, the addition of hydrophobically modified non-ionic polyol significantly increases the shelf life of the metal cleaner, metal polish, and anti-tarnish solution.

Any number of colorizing agents, such as dyes may be optionally employed to tint or colorize the solution, making it blue, green, red or any other color.

Any number of fragrance essences may be optionally employed, including but not limited to any commercially available scent or perfume.

The metal cleaner, metal polish, and anti-tarnish solution and method for making same described in detail herein disclose arrangements of elements of particular composition for illustrating preferred embodiments of structure and method of making/formulation of the present inventive composition. It is to be understood however, that elements of different composition and other ingredients thereof, other than those disclosed and described may be employed for providing a metal cleaner, metal polish, and anti-tarnish solution and method for making same in accordance with the spirit of the invention, and such changes, alterations and modifications as would occur to those skilled in the art are considered to be within the scope of this invention as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

We claim:

1. A metal cleaner, metal polish, and anti-tarnish solution comprising:

a) about 5.00 to 10.00 percent mineral spirits by volume;
b) about 1.50 to 4.50 percent ethanol by volume;
c) about 0.50 to 1.50 percent ammonia by volume;
d) about 0.50 to 1.50 percent thiourea by volume;
e) about 0.25 to 1.00 percent sulfamic acid by volume;
f) less than about 0.20 percent disodium cocoampho-diproprionate by volume; and fill up (q.s.) to 32 ozs. with deionized water.

2. The metal cleaner, metal polish, and anti-tarnishing solution according to claim 1, further comprising a suspension agent.

3. The metal cleaner, metal polish, and anti-tarnishing solution according to claim 2, wherein said suspension agent is Xanthan Gum.

4. The metal cleaner, metal polish, and anti-tarnishing solution according to claim 1, further comprising a thickening/stabilizing agent.

5. The metal cleaner, metal polish, and anti-tarnishing solution according to claim 4, wherein said thickening/stabilizing agent is a hydrophobically modified non-ionic polyol thickener/stabilizer compound.

6. The metal cleaner, metal polish, and anti-tarnishing solution according to claim 1, further comprising an abrasive additive as a polishing agent.

7. The metal cleaner, metal polish, and anti-tarnishing solution according to claim 6, wherein said abrasive additive is an oxide selected from the group consisting of iron oxide, red oxide, green oxide, and aluminum oxide.

8. The metal cleaner, metal polish, and anti-tarnishing solution according to claim 6, wherein said abrasive additive is a powder selected from the group consisting of Tripoli powder and Whiting powder.

9. The metal cleaner, metal polish, and anti-tarnishing solution according to claim 1, further comprising a fragrance.

10. The metal cleaner, metal polish, and anti-tarnishing solution according to claim 1, further comprising a colorizing agent.

11. A method for making a metal cleaner, metal polish, and anti-tarnish solution, comprising the steps of:

a) providing about 5.00 to 10.00 percent mineral spirits by volume;
b) providing about 1.50 to 4.50 percent ethanol by volume;
c) providing about 0.50 to 1.50 percent ammonia by volume;
d) providing about 0.50 to 1.50 percent thiourea by volume;
e) providing about 0.25 to 1.00 percent sulfamic acid by volume;
f) providing less than about 0.20 percent disodium cocoampho-diproprionate by volume; and mixing the above ingredients, then filling up (q.s.) to 32 ozs. total volume with deionized water.

12. The method for making a metal cleaner, metal polish, and anti-tarnishing solution according to claim 11, wherein a suspension agent is added.

13. The method for making a metal cleaner, metal polish, and anti-tarnishing solution according to claim 12, wherein said added suspension agent is Xanthan Gum.

14. The method for making a metal cleaner, metal polish, and anti-tarnishing solution according to claim 11, wherein a thickening/stabilizing agent is added.

15. The method for making a metal cleaner, metal polish, and anti-tarnishing solution according to claim 14, wherein said added thickening/stabilizing agent is a hydrophobically modified non-ionic polyol thickener/stabilizer compound.

16. The method for making a metal cleaner, metal polish, and anti-tarnishing solution according to claim 11, wherein an abrasive additive is added as a polishing agent.

17. The method for making a metal cleaner, metal polish, and anti-tarnishing solution according to claim 16, wherein said abrasive additive is an oxide selected from the group consisting of iron oxide, red oxide, green oxide, and aluminum oxide.

18. The method for making a metal cleaner, metal polish, and anti-tarnishing solution according to claim 16, wherein said abrasive additive is a powder selected from the group consisting of Tripoli powder and Whiting powder.

19. The method for making a metal cleaner, metal polish, and anti-tarnishing solution according to claim 11, wherein a fragrance is added.

20. The method for making a metal cleaner, metal polish, and anti-tarnishing solution according to claim 11, wherein a colorizing agent is added.

* * * * *